US006936227B1

(12) United States Patent
De Souza et al.

(10) Patent No.: US 6,936,227 B1
(45) Date of Patent: Aug. 30, 2005

(54) FEED-DISPERSION SYSTEM FOR FLUID CATALYTIC CRACKING UNITS

(75) Inventors: Edson José Joaquim De Souza, São Mateus do Sul (BR); Aurélio Medina Dubois, Rio de Janeiro (BR); Cláudio Damiance Baptista, Rio de Janeiro (BR); José Geraldo Furtado Ramos, Rio de Janeiro (BR); José Loreto Moreira De Faria, Niterói (BR); Moacir José Bampi, Porto Alegre (BR)

(73) Assignee: Petroleo Brasileiro S.A.-Petrobras, Rio de Janeiro (BR)

( * ) Notice: Subject to any disclaimer, the term of this patent is extended or adjusted under 35 U.S.C. 154(b) by 886 days.

(21) Appl. No.: 09/694,774

(22) Filed: Oct. 24, 2000

(30) Foreign Application Priority Data

Dec. 14, 1999 (BR) ..... 9905840

(51) Int. Cl.[7] ..... B05B 7/04; B05B 7/08; B01J 8/08

(52) U.S. Cl. ..... 422/140; 422/139; 422/140; 422/224; 239/434.5; 239/554; 239/556; 239/558

(58) Field of Search ..... 422/139, 140, 422/224, 231; 239/433, 434.5, 549, 554, 239/556, 558, 567; 208/55, 106, 113

(56) References Cited

U.S. PATENT DOCUMENTS

| | | | | |
|---|---|---|---|---|
| 4,434,049 A | | 2/1984 | Dean et al. | 208/153 |
| 5,037,616 A | | 8/1991 | Williatte et al. | 422/140 |
| 5,173,175 A | | 12/1992 | Steffens et al. | 208/157 |
| 5,554,341 A | | 9/1996 | Wells et al. | 422/145 |
| 5,673,859 A | | 10/1997 | Haruch | 239/568 |
| 5,794,857 A | | 8/1998 | Chen et al. | 239/430 |
| 6,088,934 A | * | 7/2000 | Newton | 34/360 |
| 6,387,247 B1 | * | 5/2002 | Chen | 208/113 |

FOREIGN PATENT DOCUMENTS

| | | | |
|---|---|---|---|
| BR | PI 8404755 | 9/1984 | C10G 11/18 |
| EP | 0 147 664 A1 | 7/1985 | C10G 11/14 |
| EP | 0 546 739 A2 | 11/1992 | C10G 11/18 |
| EP | 0 864 633 A2 | 9/1998 | C10G 11/16 |

OTHER PUBLICATIONS

Patent Abstract of Brazil PI BR 8404755 Sep. 21, 1984.

* cited by examiner

*Primary Examiner*—Alexa Doroshenk
(74) *Attorney, Agent, or Firm*—Sughrue Mion, PLLC

(57) ABSTRACT

A feed-dispersion system for hydrocarbon feeds of fluid catalytic cracking units is described, which comprises:

a feed-injection system made up of two concentric conduits, where the atomization fluid flows through the inner conduit, while the liquid feed flows through the annular space formed by the outer surface of the inner conduit and the inner surface of the outer conduit;

an atomization unit having nozzles arranged in rows, with one row having central nozzles connected to the inner conduit for atomization fluid, and two or more rows of side nozzles, connected to the outer feed conduit, the central nozzles and side nozzles of the atomization unit being geometrically placed so that the energy of the atomization fluid is fully transferred by contact to the flow of feed, this resulting in the complete atomization of the feed;

a mixing chamber formed by the edges of the central nozzles, the dimensions of which are able to prevent the coalescence of the formed oil droplets.

39 Claims, 6 Drawing Sheets

FIG. 2
FIG. 2A
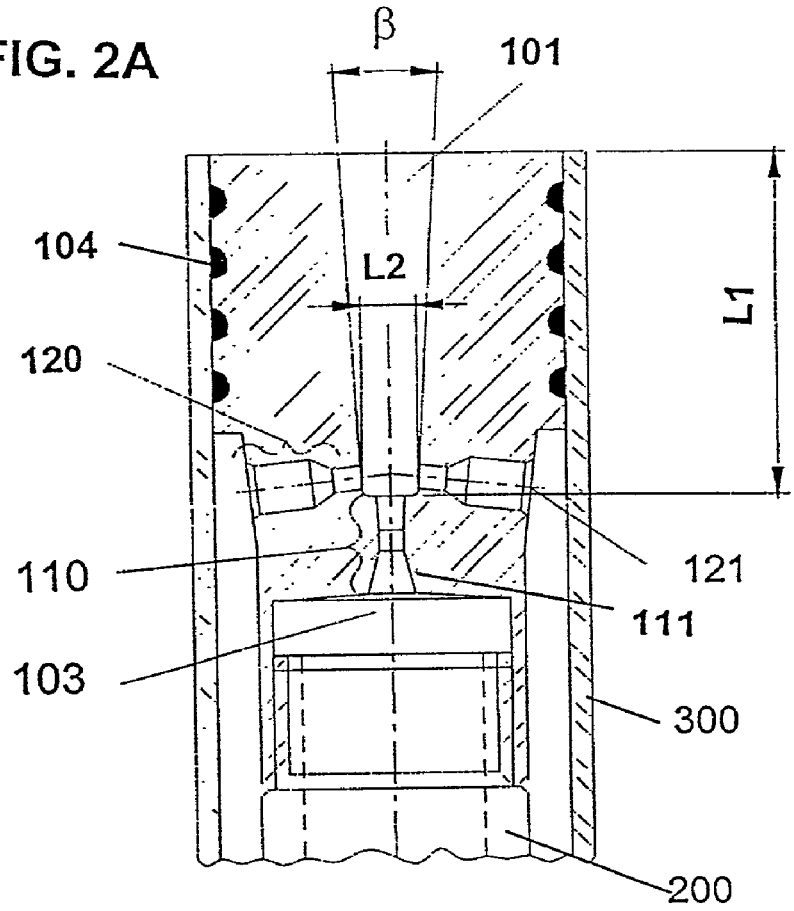
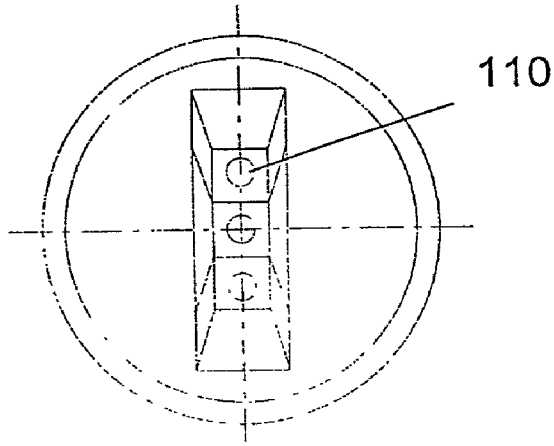
FIG. 2B

FIG. 4
FIG. 4A
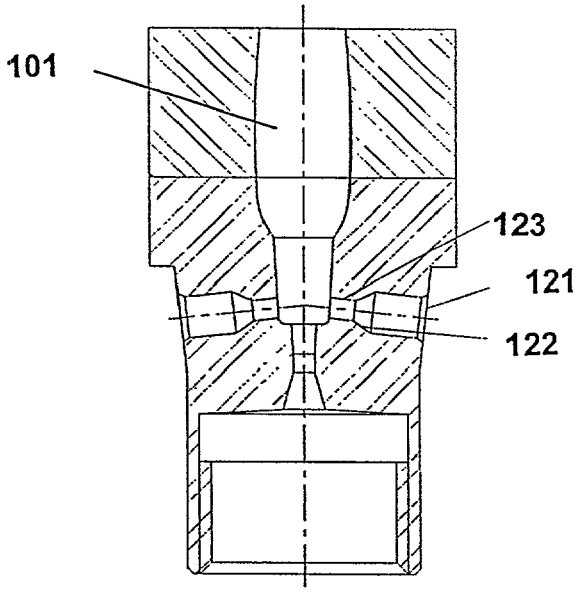
CURVED
FIG. 4B
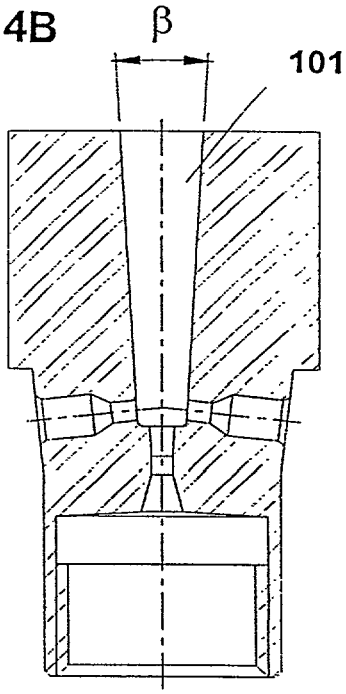
STRAIGHT

FEED-DISPERSION SYSTEM FOR FLUID CATALYTIC CRACKING UNITS

FIELD OF THE INVENTION

The present invention relates to a feed-dispersion system for the optimized dispersion of hydrocarbon stocks as feeds for catalytic cracking units (FCC), more specifically, to a feed-dispersion system able to promote the full atomization of a hydrocarbon feed added or not of high boiling point fractions, said system comprising a unique geometrical arrangement so that the energy transferred from the atomizing fluid to the hydrocarbon feed is fully used for the feed atomization. The invention relates further to the FCC process that uses the feed-dispersion system of the invention.

BACKGROUND INFORMATION

Fluid catalytic cracking (FCC) is a main process for obtaining highly ranked petroleum related products, such as gasoline, diesel oil and liquid petroleum gas (LPG), from heavy feeds having usable light fractions. The feeds most often submitted to the FCC process are generally those refinery streams that have origin in side cuts of vacuum towers, called heavy vacuum gasoil, or heavier streams that find origin in the bottom of atmospheric towers called atmospheric residue or even a mixture of those streams.

Such streams, when submitted to the FCC process, are contacted with a catalyst made up of a fine particulate material in a conversion zone in the absence of hydrogen and are converted in lighter and more valuable hydrocarbon streams, separated from streams that are even heavier than the feed.

In spite of the fact that the FCC process is more than 50 years old, techniques that might improve the process are continuously sought, increasing the yield in products of higher intrinsic value. Generally, it is agreed that the main goal of the FCC processes is the maximization of the production of higher intrinsic value products.

One relevant aspect of the process is the initial contact of the catalyst with the feed; that is, the interaction promoted by the above cited dispersion systems has a marked influence on the conversion and selectivity to valuable products.

A few trials aiming at improving the contact between the catalyst and the feed have been carried out, always based on the idea of promoting a quick vaporization of the feed as well as an intimate contact with the catalyst during the small period of time available within the riser. In order to process the catalytic cracking reactions it is required that the vaporization of the feed in the area of mixture with the catalyst occurs within a few milliseconds so that the molecules of the vaporized hydrocarbons may contact the catalyst particles, permeating through the catalyst macropores and suffering the effect of the acid sites that promote the catalytic cracking. If a quick vaporization does not occur, the result is a thermal cracking of the still liquid fractions.

It is well known that the thermal cracking leads to the formation of by-products such as coke and fuel gas, mainly in the case of residuum-containing charges. Therefore, the cracking on the riser bottom undesirably competes with the catalytic cracking that is the object of the FCC process.

One important parameter for the feed atomization is its temperature in the atomizer. Some of its physical properties such as viscosity and surface tension are altered as a function of temperature and during the atomization process result in a universe of lower diameter droplets. Therefore a substantial increase in the contact area by the surfaces of the droplets present in the spray occurs, this entailing a significant impact on the ease of vaporization. For residual feeds used in the FCC process and at the recommended temperature ranges, it may be demonstrated that the increase in contact area by using higher feed temperatures may attain 30%. However the feed temperature cannot be indefinitely increased since there is the risk of coke build up and non-selective thermal cracking within the feed furnaces.

On the other hand the quick vaporization of the feed will be obtained more easily if the feed is suitably atomized, so as to form a thin spray on the catalyst phase. In order to obtain that spray several models of feed injectors in the riser have been developed.

According to one of the first of such developments, the feed and the steam were added to the catalyst from the regenerator with the aid of a Y tube, in a system known as "Y jet", which in practical terms nearly did not disperse the feed, leaving to the hot catalyst the transfer of heat to the feed and the subsequent vaporization. This model was acceptable for lighter feeds where the vaporization caused by the heat transferred by the catalyst was practically instantaneous.

Since the eighties, with the advent of heavier feeds from heavier oils in the FCC units, several modifications were introduced in the feed injection system. One of such changes has been the replacement of the so called single feed-dispersion system by multiple feed-dispersion system, placed at elevations between 30° and 70°, at one or more levels, so as to provide a better feed dispersion as well as a better contact with the catalyst. The standard flat spray was at first widely used for this purpose.

Other kinds of feed-dispersion systems have been developed concomitant to the increase in the severity of the feeds to be cracked.

U.S. Pat. No. 4,434,049 teaches the atomization of a water/oil emulsion by a feed-dispersion system the feature of which is the modification of the size of the oil particles by the impact of the emulsified feed against a flat cylindrical surface. As alleged by the authors, the feed-dispersion system produces a spray having oil particles of circa 500 micra diameter that are then accelerated by the steam entering by a spot perpendicular to the feed inlet. The inlet rate of steam causes that the oil particles are submitted to shear, this rendering such particles still smaller; the mixture of steam and emulsified feed is accelerated up to an outlet nozzle having a special geometry so as to obtain the feed dispersed as a fine spray. However, the described device requires that the feed be introduced as an emulsion with water so that the surface tension is reduced, and then the water/oil micelles are broken by the impact against the flat cylindrical surface.

European patent EP 546739 relates also to a device for the feed injection that uses the principle of breaking oil particles through the collision with a flat surface, without however requiring the previous emulsification of the oil with water.

Brazilian PI BR 8404755 teaches a feed-injection device where the feed and the atomizing fluid -steam- are admixed within a chamber in order to promote the dispersion of the feed in an efficient way. The mixing chamber bears a central pin the diameter of which controls the flow rates in the annular space. The atomizing fluid, distributed through several holes, enters perpendicularly to the feed. A mist is then formed that is directed to the interior of the riser.

U.S. Pat. No. 5,037,616 (corresponding to European EP 312428) teaches that a good dispersion of the feed with vapor may be obtained with the aid of a feed injector featured by a venturi tube. Dimensions characterize the geometry of this device such that the speed of the feed and steam mixture reaches sonic conditions at the venturi throat. On its turn, the venturi tube shows a cylindrical internal section and is situated between the converging and diverging sections. The continuity of the converging, cylindrical and diverging sections is smoothly made by means of a curved section. The superior angle of the device with the venturi tube is around 5° to 15° and the diameter of an exit hole is at most 2 to 5 times the venturi tube diameter. In the average, oil droplets having diameters of the order of 10 to 50 micra are formed, that are injected in the riser at speeds of the order of 60 to 150 meters by second.

U.S. Pat. No. 5,173,175 teaches a device for feed injection into a fluid catalytic cracking reaction zone, the device comprising a straight section where the feed and steam are pre-mixed and a terminal section where oil is atomized and dispersed by means of a fan-like distributor. The feed injector yields a flat vaporization standard that is perpendicular to the catalyst flow direction in the contact section between the catalyst and the oil in the cracking zone. It is alleged that better product yield and less coke and gas are produced. The system described in said US patent works so that the fluids are admixed prior to the element that promotes the feed atomization and causes the fan-like jet formation. On the contrary, in the present application the fluids are admixed exactly on the bottom of the device that promotes the atomization and the formation of the fan-like flat jet. The atomization is promoted by the efficient contact between the steam from the atomizing fluid nozzle (the fluid being generally steam) and the couple of charge nozzles that surround the atomizing nozzle.

Besides, the working condition described in U.S. Pat. No. 5,173,175 as well as in all documents where the technique employs the previous mixture of the feed and the atomization fluid causes the following feature linked to the loss of charge (or $\Delta P$ to conform to the widely spread jargon). The previous mixture makes that the loss of charge between the interior of the riser where the charge jet and atomizing fluid is admixed to the catalyst is shared by both fluids, charge and atomizing fluid. Common charge loss implies that a considerable portion of the energy of the atomization fluid is not used for promoting the atomization.

U.S. Pat. No. 5,673,859 teaches a vaporization nozzle for fluid catalytic cracking that shows two discharge orifices elongated in the cross direction to effect a fine atomization of the liquid hydrocarbon charge as said charge is vaporized by the nozzle. Preferably the orifices are inclined so as to produce a convergent spray but may be inclined to produce a divergent spray or a substantially flat spray. The basic principle of said system is to use the dissipation of kinetic energy of the charge through the inelastic shock with metal bar 13 to promote atomization. Thus, to obtain good atomization a high pressure upstream of device 15 is required. Due to the reduction to the square in kinetic energy with feed flow rate, by working with reduced feed flow rates the atomization performance would be seriously jeopardized. On the contrary, in the present application this effect does not exist since the atomization energy is independent of the charge flow rate.

U.S. Pat. No. 5,794,857 corresponding to PI BR 9607665-8A, teaches a device for feed injection mounted with two concentric conduits where the inner conduit is the steam conduit and the outer conduit, the feed conduit, so that both conduits define an annular liquid conduit for the feed. The outlet end of the inner conduit is semi-spherical and has a row comprising a plurality of holes therein for the passage of the steam; the also semi-spherical outlet end of the outer conduit has an elongated slit parallel to the orifices of the semi-spherical outlet of the inner conduit for passage of steam and feed as a spray. It is alleged that the device allows for the operation at low steam pressure, or even in the absence of steam in case any problem occurs caused by the refinery steam feed. Contrary to the technique taught in the said US patent, in the present application the energy of the atomization fluid is transformed in a more efficient way using a converging section having a variable converging angle so as to make an efficient conversion of the atomization fluid pressure into kinetic energy and promoting the feed atomization. The contact of the feed with the atomization fluid is carried out by means of nozzles that direct the contact of the feed with steam so that the generated kinetic energy is transmitted to the feed, instantaneous and intense atomization being promoted.

Therefore, the patent literature does not teach nor suggest the purpose of the present invention, that is, a feed-dispersion system whose geometry is able to promote the atomization of the feed so that the average diameter of the oil particles is in the range of 100 micra, with the improved use of the transfer of the atomization fluid energy to the feed. This way, a better performance of the process and the catalytic cracking fluid unit is made possible.

SUMMARY OF THE INVENTION

The present invention comprises a feed-dispersion system for liquid hydrocarbon feeds of FCC units.

Broadly, the present invention comprises a feed-dispersion system for FCC units having the following characteristic features:

- a feed-injection system made up of two concentric conduits of substantially circular section, where the atomization fluid flows through the inner conduit, while the liquid feed flows through the annular space formed by the outer surface of the inner conduit and the inner surface of the outer conduit;
- an atomization unit having a row comprising a plurality of nozzles, with one row having central nozzles connected to the inner conduit for atomization fluid, the symmetry axis of the nozzles being parallel or not to the symmetry axis of the inner/outer conduits, and two or more side nozzles, connected to the outer feed conduit, the symmetry axis of said side nozzles being or not parallel to the symmetry axis of the conduits; while in this unit:
  - the central and side nozzles are geometrically placed so that the energy of the atomization fluid is optimally transferred by contact to the flow of feed with the result of the complete atomization of the feed;
  - a mixing chamber is formed by combining the discharge zones of the central nozzles, said chamber being the geometrical locus formed by the sequence of free surfaces downstream each contact spot of the atomization fluid and the liquid feed, said chamber having dimensions able to prevent the coalescence of the formed oil droplets.

The feed injection system of the invention is designed to be radially coupled by 2, 4, 6 or more units to the riser of a conventional fluid catalytic cracking unit.

The feed-dispersion system of the invention may be coupled to one, two or more levels of the riser, at an elevation angle between 30 and 70°, according to the needs of the fluid catalytic cracking process.

The present invention provides a feed-dispersion system able to atomize the feed by the efficient use of the energy of the atomization fluid. Besides, it keeps its excellent performance for a wide range of operating conditions.

The present invention provides also a feed-dispersion system that yields a mist of atomized feed having an average droplet diameter adequated to the improved interaction with the catalyst grains.

The present invention provides still an atomization unit having an arrangement of the outlet nozzles that makes possible to operate with a ratio of the atomization fluid nozzles to feed equal or higher than 1.

The present invention provides further a feed-dispersion system that makes possible a better conversion of the feed into valuable products such as gasoline and naphtha.

The present invention provides still a feed-dispersion system whose construction allows lower feed losses and consequently lowers pumping powers of the hydrocarbon feed flow.

The present invention provides further a higher-conversion FCC process, with improved yields in valuable products and lower yields in coke and gas as a consequence of the use of the feed-dispersion system of the invention.

BRIEF DESCRIPTION OF THE DRAWINGS

FIG. 2 shows the details of the atomization unit. FIG. 2A is a cut along the longitudinal axis while FIG. 2B is a superior view.

FIG. 4A and FIG. 4B both show modes respectively curved and straight of the mixing chamber of the atomization unit according to the invention.

DETAILED DESCRIPTION OF THE PREFERRED EMBODIMENTS

The present invention relates to a feed-dispersion system for feeds of catalytic cracking units (FCC) aiming at obtaining the finely atomized feed so as to attain a better contact between the feed and the regenerated catalyst. This way the thermal cracking reactions as well as the formation of coke and fuel gas are minimized. Consequently, the yield in valuable products is maximized.

The present invention is directed to any kind of feed, but more preferably to heavy feeds, such as heavy gasoils and the mixtures of gasoils and atmospheric resid, for example.

The atomizing fluid is any inert gas such as nitrogen, fuel gas or steam, for example, medium or low-pressure steam usually produced in the refinery, steam being preferred in view of its low cost and availability.

The invention will now be described in more detail combined to the attached FIGURES.

Figure 1:
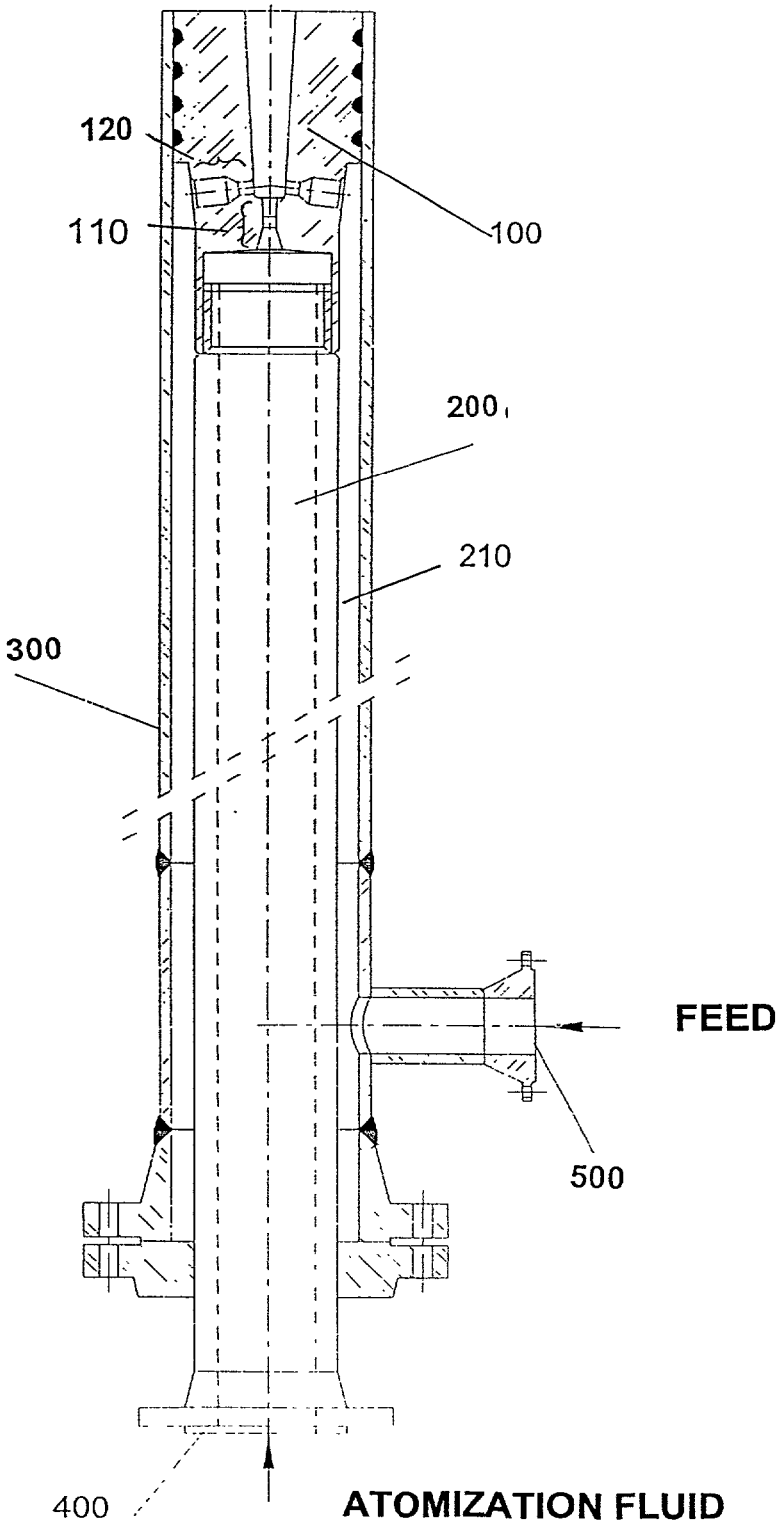
FIG. 1 shows a feed-dispersion system according to the present invention, with the inlet flanges, conduits for carrying fluids and the atomization unit.

FIG. 1 illustrates a cut along the longitudinal axis of the feed dispersing system that is the object of the present invention, herein represented by a drawing in longitudinal cut according to the Brazilian Standard ABNT NBR 10647. The system is made up of an outer conduit (300) and inner conduit (200), annular space (210), atomization fluid inlet (400) and hydrocarbon liquid feed inlet (500), besides an atomization unit (100) that partially enters the interior of the riser (not represented) of the FCC unit. The atomization unit (100) has central nozzles (110) for atomization fluid and side nozzles (120) for liquid feed.

The concentric conduit system conveys the atomization fluid and the liquid feed up to the atomization unit (100) where the flows of atomization fluid and liquid feed will encounter. The relative arrangement of the central and side nozzles will cause the complete atomization of the feed while promoting the optimized interaction with the catalyst present in the riser. The contact with the finely atomized feed and the hot regenerated catalyst promotes the vaporization of the liquid feed this contributing in large part for the improved performance of the FCC unit.

The pre-heated feed for the FCC unit is conveyed via the annular space (210) created between the inner wall of the outer conduit (300) and the outer wall of the inner conduit (200), while the inner conduit (200) conveys the atomization fluid, normally steam. The amount of atomization fluid employed varies of from 1 to 5 weight % based on the feed, more preferably of from 2 to 4 weight %, even for heavy and viscous feeds or having a high content of carbon residue.

The mixture between the liquid feed and the atomization fluid occurs in the atomization unit (100), the geometry of which is essential for the complete atomization of the feed, such as described and claimed in the present invention.

According to FIG. 1, the pre-heated liquid feed is introduced in the dispersing system through flange (500) and conveyed through the annular space (210) formed by conduits (200) and (300). The flow of feed attains the side nozzles (120) of the liquid feed in order to be placed, through the discharge orifice of said nozzles, in a collision path with the jet of atomization fluid from the central nozzles (110). Thus in the system of the invention the side nozzles (120) represent the only exit for the flow of liquid feed conveyed through the annular space (210).

FIG. 2 illustrates one of the preferred modes of the present invention where the atomization unit (100) is represented as a cut (FIG. 2A) shown with hatcheries according to the Brazilian Standard ABNT NBR10647. A superior view (FIG. 2B) shows the orifices of three atomization fluid nozzles (110). Such nozzles (110) aim to accelerating the flow of the atomization fluid. This number of nozzles, in case 3 nozzles, was adopted only as an example, and may be higher or lower or even it may be one single nozzle, this aspect not being limiting of the invention.

The atomization fluid is introduced into the injection feed system through flange (400) and conveyed through the inner conduit (200), eventually reaching an antechamber (103) formed by the space between the tip of the inner conduit (200) and the inlets (111) of the central nozzles (110) of atomization fluid. Such nozzles (110) may be parallel or not to the longitudinal axis of the feed injection system. Thus, in the inventive system the central nozzles (110) are the only exit for the atomization fluid out of the conduit (200).

Nozzles (110) accelerate and place the flow of atomization fluid towards mixing chamber (101) described hereinbefore.

The shape of the antechamber (103) is not critical, and may vary widely, without affecting the performance of the feed injection system.

Figure 3:
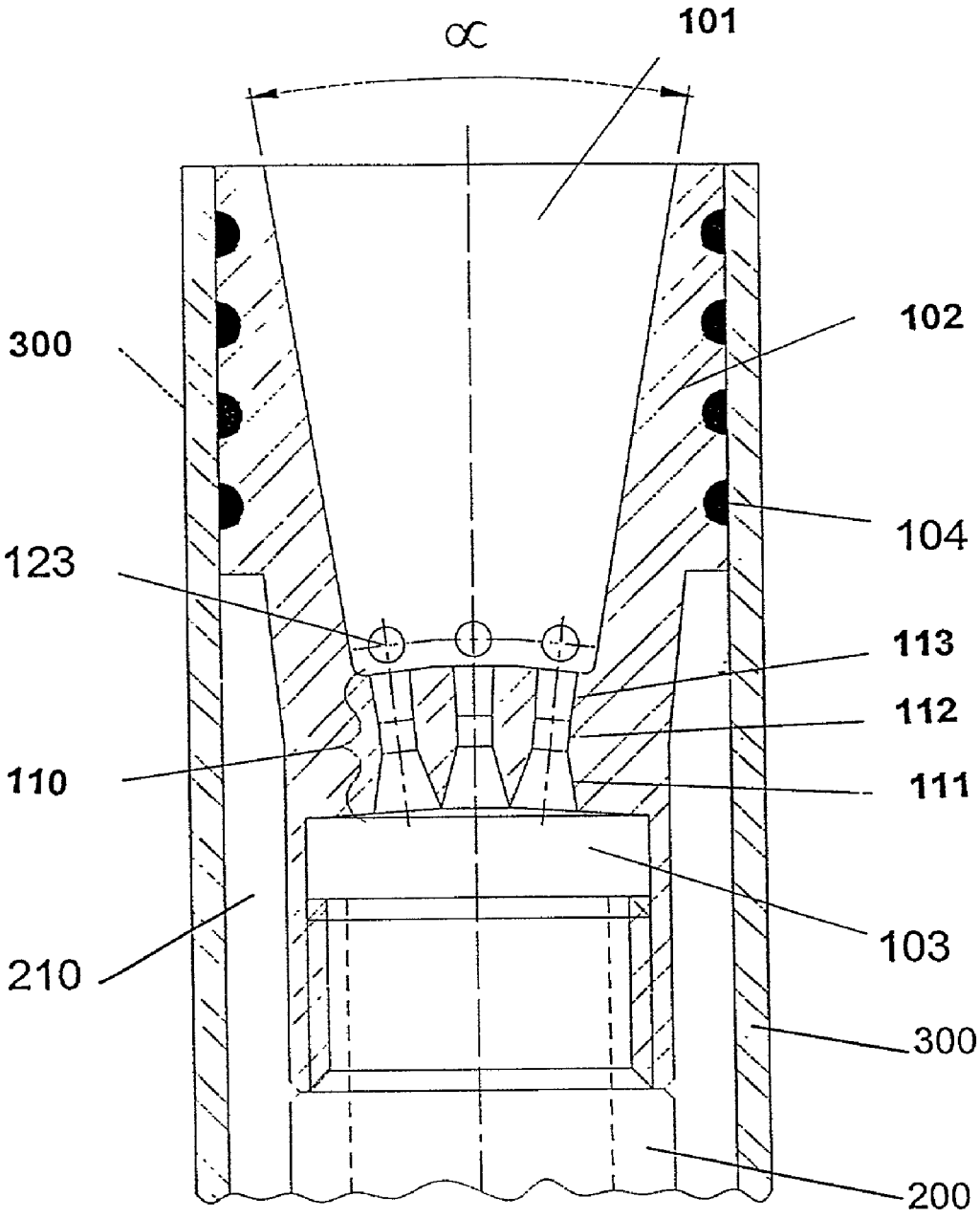
FIG. 3 is a cut along the longitudinal axis at 90° of FIG. 2A.

In FIG. 3 the atomization unit (100) is shown in detail by means of a cut in a longitudinal plan 90 degrees of the plan of FIG. 2A.

The central nozzles (110) of atomization fluid may show any shape of section, convergent, convergent/divergent or cylindrical. FIG. 3 illustrates respectively at (111), (112) and (113) for example, a convergent nozzle (111), a divergent nozzle (113), intermediated by a cylindrical section (112), this arrangement not being a limiting aspect of the invention.

The number of side feed nozzles (120) may be one, two or more for each central nozzle (110) of atomization fluid. In FIG. 2A are represented, as an example, two side feed nozzles (120) for each central atomization fluid nozzle (110).

FIG. 4A illustrates the liquid feed side nozzle (120) having a geometry of convergent orifices, respectively the inlet (121), the inner bevel (122) and the discharge orifice (123). Such geometry is directed to the least possible loss of charge but is not limiting for feed injection, and may take different shapes such as convergent or cylindrical.

In the present application, where the atomization fluid and the liquid feed flow independently in the riser until they are admixed at the bottom of the mixing chamber (101), the pressure of the atomization fluid is optimized, at the required degree, to promote atomization. Therefore, the loss of charge of the liquid feed circuit or drop in static pressure may be varied without restriction in order to be adapted to the local conditions of its application. The static pressure drop in principle may be varied between 1 and 10 bar, preferably between 1.5 to 5 bars, still more preferably between 2 and 3.5 bar. On the other side, the pressure drop of the atomization fluid may vary between 2 and 20 bar, preferably between 3 to 15 bar, and more preferably between 5 and 10 bar. Any combination of said loss of charge for the two fluids might be employed without departing from the scope of the invention.

A detail of the atomization fluid nozzle (110) in FIG. 3, is its beveled finishing. In case convergent/divergent or only convergent nozzles are used, the edges of the convergent section (111) may have inclination angles between 30° and 120°, preferably between 40° and 90°, more preferably between 50° and 80°. The divergent section (113) may also show angles between zero and 90°, preferably, from 5° to 30°, more preferably from 6° to 14°. The leveled straight finishing is not a limiting aspect of the invention and may even show concordance rays or, as is known by the experts, sweetening rays.

As mentioned before, the number of central atomization nozzles (110) may vary, as a function of the flow rate of the atomization fluid. The preferred modes of the invention consider a number of nozzles (110) that may vary between 1 and 12, preferably 4 to 9, and more preferably 3 to 7 nozzles (110).

The number of side nozzles (120) for liquid feed shown in FIG. 2 for the feed outlet as mentioned hereinbefore, is equal or higher than the number of central nozzles (110) for atomization fluid. According to the mode shown in the FIGURES, the number of liquid feed side nozzles (120) is 6, distributed according to the rate of 2 feed nozzle (120) for each nozzle (110) for atomization fluid. As described before, this number is only an example, and may be varied without being a limiting aspect of the invention.

According to FIG. 3 and as usually found in the technique, the sealing between the body (102) of the atomization unit (100) and the outer conduit (300) is made by grooves known by the experts as "labyrinth" and are indicated by numeral (104). Such grooves, specifically dimensioned by the usual mode in the technique, assure the sealing of the atomization unit (100) with the conduit (300) through which the liquid feed flows.

According to FIG. 2A, the combination of the flows of feed and atomization fluid provides the prompt atomization of the liquid stream and generates a spray, a universe of droplets in a mixing chamber (101) designed so as to avoid the coalescence of the feed droplets freshly dispersed by the atomization fluid.

Chamber (101) is an open space where the liquid jets from the side feed nozzles (120) and already atomized by the high speed jets of the atomization fluid are admixed and form a homogeneous spray having a fan-like shape. FIG. 2B illustrates the mixing chamber (101) as a superior view having the shape of a rectangular slit. This kind of slit is only an example, since the opening of the discharge of the mixing chamber (101) may have several shapes, including round shapes, this not constituting a limiting aspect of the invention.

An important parameter related to the mixing chamber (101) is the dimensional ratio L1/L2 between, respectively, the length and the width of the bottom of the chamber. According to the geometry developed by the Applicant for the feed-dispersion system of the invention, the dimensional ratios L1/L2 are comprised in the range of from 0.5 to 20, more preferably between 1 and 10, still more preferably between 2 and 7.

The mixing chamber (101) entails two characteristic opening angles, respectively, β shown in FIG. 2 and α, shown in FIG. 3.

Angle α is the opening angle of the mixing chamber, as measured in the direction of the sequence of atomization fluid nozzles (110).

Angle β is the characteristic angle of the opening of the mixing chamber (101), measured perpendicularly to the sequence of atomization nozzles.

The variation in α and β leads to the creation of several openings of the mixing chamber (101). According to the preferred mode angle α may vary between 5 and 90°, preferably in the range of from 10° to 60°, α being a function of the number of nozzles (110). Accordingly, angle β may vary between zero and 20°, preferably in the range of from 1° to 12°.

As for the shape taken by mixing chamber (101), as illustrated in FIGS. 4A and 4B, it can vary among the curved surfaces (FIG. 4A) and up to a prism shape (FIG. 4B). A preferred however not limiting format is a frustum of a pyramid with the two featured angles α and β being perpendicular one to the other.

Figure 5:
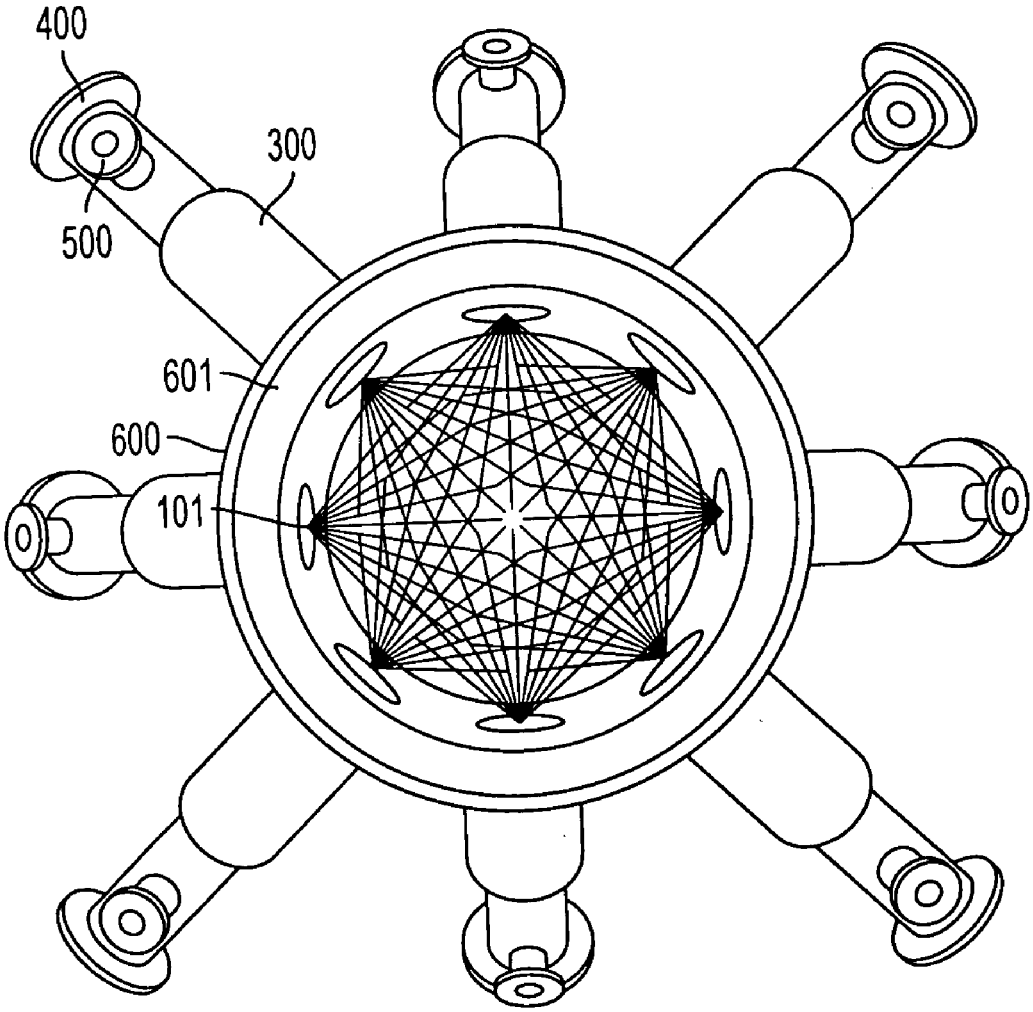
FIG. 5 shows a top or superior view of two offset rows of four feed-dispersion systems according to the present invention, radially coupled to an FCC riser, at two riser levels.
Figure 6:
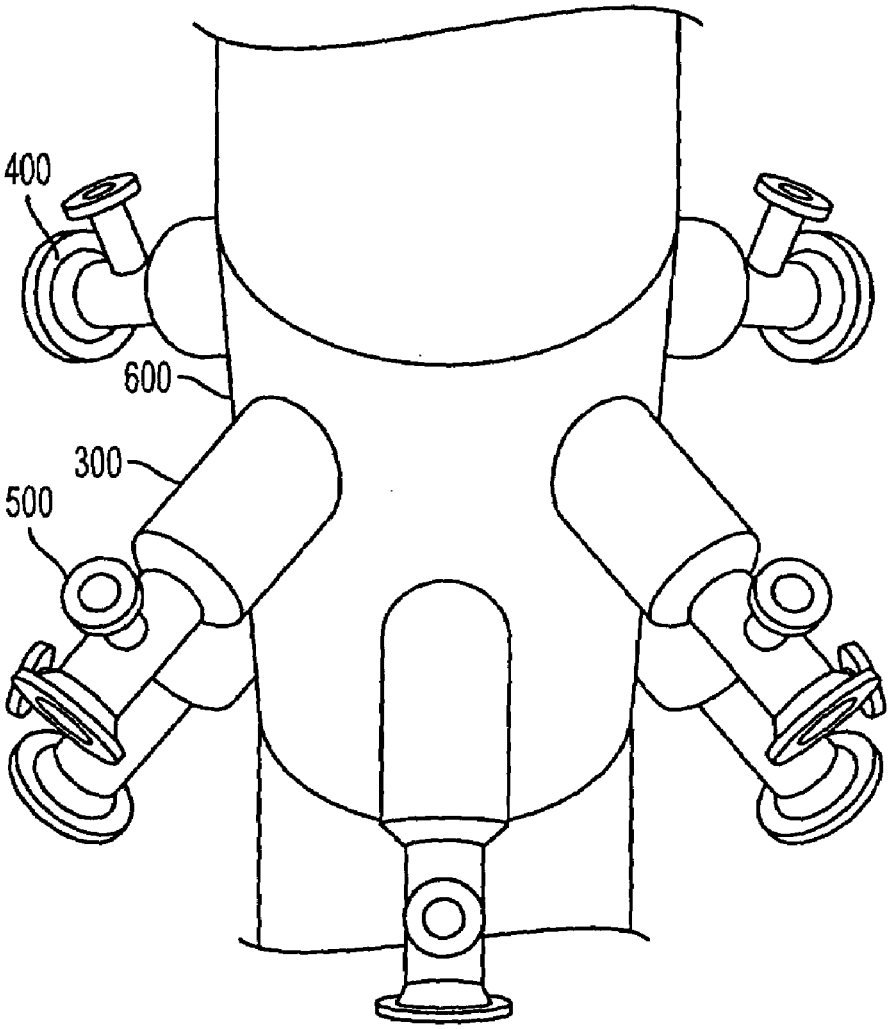
FIG. 6 shows a perspective view of two offset rows of four feed-dispersion systems according to the present invention, each radially coupled to an FCC riser, at two riser levels.

FIGS. 5 and 6 illustrate an embodiment having two offset rows of four feed-dispersion systems according to the invention, radially coupled to the riser of a fluid catalytic cracking unit, at two riser levels, at an elevation angle between 30 and 70°.

FIG. 5 is a top or superior view of two offset rows of four feed-dispersion systems radially coupled to, or installed in, an FCC riser, where the direction of each of the four systems is upward and the overall spatial arrangement is illustrated. The interior of the riser (601) is shown as being filled with a network of the intermingled, vaporized feed and atomization fluid. The concept of the invention encompasses other configurations where two, six or more of said systems are radially coupled to a riser in a fluid catalytic cracking unit.

FIG. 6 is a perspective view showing two offset rows of four feed-dispersion systems according to the invention, each radially coupled to an FCC riser.

In FIGS. 5 and 6, the flanges (500) for the introduction of pre-heated liquid feed, the flanges (400) for the introduction of the atomization fluid, the outer conduits (300), the mixing chambers (101), and a portion of the FCC unit riser (600) and the interior thereof (601), are illustrated.

As is well known by the experts, the flow of the atomizing fluid transfers high rates of quantity of movement and energy to the flow of feed. Therefore, the quick acceleration makes the liquid feed unstable, this generating unstable ligaments that give origin to drops and finally to the droplets of the atomized spray. Ligaments are liquid portions of the feed, rendered unstable by the high transfer rate of quantity of movement conveyed by the atomization fluid. The ligaments are the precursors of the atomized hydrocarbon droplets. Particularly, the feed-dispersion system as suggested by the present invention bears a geometry that provides for the transfer of said quantity of movement and energy in highly efficient form, so as to minimize losses and reaching small average diameters in the spray droplets.

The atomization reached by the feed-dispersion system according to the present invention makes possible that a jet of feed droplets is formed. This concept leads to excellent results in the conversion profile of a hydrocarbon feed submitted to a fluid catalytic cracking process. Such results result from the generation of a universe of droplets having statistical average diameter and flow rate mass distribution suitable to a perfect interaction with the catalyst.

The present system provides further the advantages consequent to low feed losses attributed to the flow of atomizing fluid and liquid feed, thus allowing lower pumping powers and lower requirements as regards the thermodynamic properties of the atomizing fluid.

The excellence of the present system may be evaluated based on the Example below, where the main conversion parameters for a same feed cracked by means of a state-of-the-art dispersion system and by means of the feed-dispersion system of the invention are compared.

EXAMPLE

TABLE 1 below presents the comparison between the performance of two feed-dispersion systems: a conventional one, adopted as the state-of-the-art control and another one a prototype of the present invention, the object of the present application. The tests were run in a FCC unit of a large Brazilian refinery, the feed features and operation conditions being kept constant. The results evidence a sensible increase in conversion to valuable fractions, particularly the cracked naphtha, with an increase of 3.08%. Further, there is a reduction in coke generation (9.46%) and fuel gas (15.65%), which agree with the mass and conversion balance. The numbers evidence the unequivocal dependence between the quality of charge injection obtained from the device of the invention and the yields of the catalytic cracking unit (FCC).

TABLE 1

| Feed and conversion features | Test 1 (control) | Test 2 Invention | Difference |
|---|---|---|---|
| Feed ($m^3$/d) | 9117 | 9115 | −2 |
| D20/4 | 0.9418 | 0.9403 | |
| RCR (% w) | 1.79 | 1.26 | |
| RTX (° C.) | 540 | 541 | +1 |
| CFT (° C.) | 273 | 243 | −30 |
| DPT (° C.) | 727 | 709 | −18 |
| C/O | 5.57 | 6.40 | |
| Product Yields (% w) | | | |
| Combined Gas | 6.77 | 5.71 | −1.06 |
| LPG | 12.55 | 12.90 | +0.35 |
| Cracked Naphtha | 43.41 | 46.49 | +3.08 |
| LCO | 15.61 | 14.38 | −1.23 |
| DO | 15.31 | 14.78 | −0.53 |
| Coke | 6.34 | 5.74 | −0.60 |
| App. Conversion (% v) | 70.46 | 73.24 | +2.78 |

TABLE 1-continued

| Feed and conversion features | Test 1 (control) | Test 2 Invention | Difference |
|---|---|---|---|
| Corrected. App. Conversion. (% v) | 71.31 | 73.65 | +2.34 |
| Neat Conversion (% v) | 87.19 | 88.55 | +1.36 |
| Naphtha Quality | | | |
| MON | 80.1 | 81.0 | +0.9 |
| RON | 94.1 | 95.5 | +1.4 |

Where:
RCR is the Ramsbottom Carbon Residue
RTX is the Reaction Temperature as measured on the top of the riser
CFT is Combined Feed Temperature
DPT is the regenerator temperature in the dense phase

We claim:

1. A feed-dispersion system for fluid catalytic cracking units (FCC) for introducing a liquid hydrocarbon feed atomized by an atomization fluid in a reactor for fluid catalytic cracking, wherein said system comprises:

a feed injection system made up of two concentric conduits, an inner conduit and an outer conduit of substantially circular section, wherein the atomization fluid is introduced through a first flange and flows through the inner conduit while the liquid hydrocarbon feed is introduced through a second flange and flows through the annular space formed by the outer surface of the inner conduit and the inner surface of the outer conduit; and an atomizing unit comprising nozzles arranged in rows, with a central row formed by the sequence of nozzles connected on one end to the inner conduit of atomization fluid and connected to a mixing chamber on the other end, and by at least one side row formed by the sequence of side nozzles connected on one end to the outer feed conduit and connected to the mixing chamber on the other end, where in this unit:

the central nozzle(s) and side nozzle(s) of the said atomizing unit are geometrically placed so as to transfer, by contact, the energy of the atomization fluid to the flow of liquid feed;

the mixing chamber is formed by the combination of discharge zones of the central nozzle(s) of atomization fluid; and the feed and atomization fluid are admixed in the mixing chamber and form a homogeneous spray having a fan-like shape which exits the outlet of the mixing chamber in an unobstructed way and in a direction substantially parallel to the symmetry axes of the central nozzles.

2. A feed-dispersion system according to claim 1, wherein the liquid hydrocarbon feed is a light gasoil, a heavy gasoil or an atmospheric residue, alone or admixed.

3. A feed-dispersion system according to claim 1, wherein the atomization fluid is an inert gas used between 1 and 5% by weight based on the weight of the feed.

4. A feed-dispersion system according to claim 3, wherein the inert gas is nitrogen.

5. A feed-dispersion system according to claim 3, wherein the inert gas is fuel gas.

6. A feed-dispersion system according to claim 5, wherein for each central nozzle of atomization fluid there are at least two feed side nozzles.

7. A feed-dispersion system according to claim 3, wherein the inert gas is steam.

8. A feed-dispersion system according to claim 3, wherein the atomization fluid is an inert gas used between 2 and 4% by weight based on the weight of the feed.

9. A feed-dispersion system according to claim 1, wherein for each central nozzle of atomization fluid there is at least one feed side nozzle.

10. A feed-dispersion system according to claim 1, wherein the number of atomization fluid nozzles varies between 1 to 12.

11. A feed-dispersion system according to claim 10, wherein the number of atomization fluid nozzles varies between 4 to 9.

12. A feed-dispersion system according to claim 10, wherein the number of atomization fluid nozzles varies between 3 to 7.

13. A feed-dispersion system according to claim 1, wherein the symmetry axes of the central nozzles are parallel to the symmetry axes of the inner/outer conduits.

14. A feed-dispersion system according to claim 1, wherein the symmetry axes of the central nozzles are non-parallel to the symmetry axes of the inner/outer conduits.

15. A feed-dispersion system according to claim 1, wherein the symmetry axes of the side nozzles are non-parallel to the symmetry axes of the inner/outer conduits.

16. A feed-dispersion system according to claim 1, wherein the mixing chamber is the geometric locus formed by the sequence of free surfaces downstream of each contact point of the atomization fluid with the feed.

17. A feed-dispersion system according to claim 16, wherein in the mixing chamber the dimensional relationship L1/L2 between respectively length and width of the bottom of said chamber is comprised in the range of from 0.5 to 20.

18. A feed-dispersion system according to claim 17, wherein in the mixing chamber the dimensional relationship L1/L2 between respectively length and width of the bottom of said chamber is comprised in the range of from 1 to 10.

19. A feed-dispersion system according to claim 18, wherein in the mixing chamber the dimensional relationship L1/L2 between respectively length and width of the bottom of said chamber is comprised in the range of from 2 to 7.

20. A feed-dispersion system according to claim 16, wherein the mixing chamber comprises an opening angle $\alpha$, measured in the direction of the sequence of nozzles of atomization fluid.

21. A feed-dispersion system according to claim 20, wherein the opening angle $\alpha$ varies between 5° and 90°.

22. A feed-dispersion system according to claim 21, wherein the opening angle $\alpha$ varies between 10° and 60°.

23. A feed-dispersion system according to claim 16, wherein the mixing chamber comprises an opening angle $\beta$ measured perpendicularly to the sequence of atomization fluid nozzle (110).

24. A feed-dispersion system according to claim 23, wherein the opening angle $\beta$ of chamber (101) varies between zero and 20°.

25. A feed-dispersion system according to claim 24, wherein the opening angle $\beta$ of chamber (101) varies between 1° and 12°.

26. A feed-dispersion system according to claim 1, wherein the central nozzle for atomization fluid is cylindrical.

27. A feed-dispersion system according to claim 1, wherein the central nozzle for atomization fluid is convergent.

28. A feed-dispersion system according to claim 1, wherein the central nozzle for atomization fluid is convergent/divergent.

29. A feed-dispersion system according to claim 28, wherein the edges of the converging section of the atomization fluid nozzle comprise sloping angles between 30 and 120°, while the diverging section comprises angles from zero to 90°.

30. A feed-dispersion system according to claim 29, wherein the edges of the converging section of the atomization fluid nozzle comprise sloping angles between 40° and 90°.

31. A feed-dispersion system according to claim 29, wherein the edges of the converging section of the atomization fluid nozzle comprise sloping angles between 50° and 80°.

32. A feed-dispersion system according to claim 29, wherein the edges of the diverging section comprise angles from 5° to 30°.

33. A feed-dispersion system according to claim 29, wherein the edges of the diverging section comprise angles from 6° to 14°.

34. A feed-dispersion system according to claim 1, wherein the side nozzle for liquid feed is cylindrical.

35. A feed-dispersion system according to claim 1, wherein the side nozzle for liquid feed is convergent.

36. A feed-dispersion system according to claim 1, wherein the convergent side nozzle comprises an inlet, an inner bevel and a discharge orifice.

37. A feed-dispersion system according to claim 1, wherein 2, 4, 6 or more of said systems are radially coupled to the riser of a fluid catalytic cracking equipment, at one, two or more riser levels, at an elevation angle between 30 and 70°.

38. A feed-dispersion system according to claim 1, wherein for each central nozzle of atomization fluid there are two feed side nozzles.

39. A feed-dispersion system according to claim 1, where the central nozzles are laterally juxtaposed.

* * * * *